United States Patent [19]

Turnbull

[11] 4,005,981

[45] Feb. 1, 1977

[54] TUNNEL KILN

[75] Inventor: John E. Turnbull, Brookville, Pa.

[73] Assignee: Hanley Company, Summerville, Pa.

[22] Filed: Apr. 28, 1975

[21] Appl. No.: 572,629

[52] U.S. Cl. ..... 432/144; 432/137; 432/146; 432/128

[51] Int. Cl.[2] ..... F27B 9/00

[58] Field of Search ..... 432/143–146, 432/163–165, 136–138, 120, 125, 128, 133, 150, 152, 176, 193

[56] References Cited

UNITED STATES PATENTS

| | | | |
|---|---|---|---|
| 1,268,204 | 6/1918 | Benjamin | 432/128 |
| 1,289,889 | 12/1918 | Owens | 432/137 |
| 1,477,675 | 12/1923 | Vincent | 432/137 |
| 1,663,029 | 3/1928 | Straight | 432/137 |
| 1,690,710 | 11/1928 | Beach | 432/146 |
| 1,858,008 | 5/1932 | Forse et al. | 432/137 |
| 3,168,298 | 2/1965 | Cook et al. | 432/137 |
| 3,172,647 | 3/1965 | Remmey | 432/145 |
| 3,219,328 | 11/1965 | Miller | 432/144 |
| 3,495,309 | 2/1970 | Kopp | 432/145 |
| 3,854,865 | 12/1974 | Fay | 432/137 |

*Primary Examiner*—John J. Camby
*Assistant Examiner*—Henry C. Yuen
*Attorney, Agent, or Firm*—Darby & Darby

[57] ABSTRACT

Tunnel kiln preheat and firing section arrangement. The firing section includes a plurality of excess air burners based along each side thereof and a plurality of exhaust ports disposed between adjacent burners. The hot combustion products from the burners plus entrained air are directed upward through damper controlled slots disposed adjacent the walls of the kiln firing section. The hot gases stream upward along the kiln wall, over along the kiln roof, downward and through the stacks of ware to be fired and then are drawn upward again with the stream of burner combustion products so as to form a powerful current of recirculating hot gases which provides a uniform firing temperature throughout the stacks of ware to be processed. The preheat section uses the hot gases exhausted from the firing section, such gases being introduced at the bottom, circulated upward, in the same manner and with the same effect as the gases in the firing section. Discharge of gases in both zones is through exhaust ports disposed adjacent the damper controlled slots.

16 Claims, 4 Drawing Figures

TUNNEL KILN

This invention relates to tunnel kiln firing and preheat sections, and, more particularly, to such tunnel kiln sections employing an improved method of transferring heat from the kiln burners to the stacks of ware to be fired.

The manufacture of brick, tile and like material (referred to as "ware") commonly includes the step of heating or firing the ware in a kiln or oven. In the large-scale manufacture the type of kiln that is commonly used is the tunnel kiln which is, in effect, an elongated kiln or oven, normally made of refractory material, through which the ware may be continuously transported as it is subjected to the desired heating conditions.

The ware to be processed is commonly transported through a tunnel kiln on flatbed ware cars which roll on rails extending through the length of the tunnel. The kiln is normally operated so that the the tunnel is full of ware cars bumper to bumper. At certain intervals a new car is pushed into the entrance of the tunnel thereby ejecting a fully processed car of ware from the exit of the tunnel. The chief advantage of such a tunnel kiln resides in the fact that the ware is processed continuously thereby yielding a high volume of production with a minimum of handling of the ware.

A tunnel kiln is commonly divided into successive zones or sections in which the temperature, atmospheric conditions, and air circulation can be controlled to effect efficient heat treatment of the ware. It is generally desirable that all of the ware being processed in a given run be exposed to the same heating conditions and thus have substantially the same qualities. Otherwise, an undue amount of sorting and wastage will be necessary to procure bricks or other ware of sufficiently uniform qualities. Typically a tunnel kiln will contain a preheating section, a firing section and a cooling section. The present invention relates to the firing and preheating sections of a tunnel kiln.

In the firing section, the ware is exposed to the maximum temperature which it experiences in the course of its processing. The heat for the firing section is supplied by means of suitably located burners. In the "open firing" type of kiln, the flames and/or products of combustion from the burners are directed over the stacks of ware on the ware cars to fire the ware and impart to it whatever qualities may be desired in the particular case.

A disadvantage of the open firing type kiln is that it is not suitable for processing certain types of ware. For example, ware made from many shales will "bloat" if subject to direct flame. In addition, considerable difficulty is experienced in controlling the flow and temperature of gases in such a firing section to provide substantially similar conditions and particularly equal temperatures for all portions of the ware stacks on the ware cars.

The problem of direct flame impingement upon the ware is avoided by the "muffle" type kiln in which the ware is "fired" by radiation from the burner flames and/or heated portions of the kiln structure. Because of the effect of distance on radiant heating and because of the screening effect of the ware itself considerable difficulty is experienced in providing substantially similar conditions and particularly equal temperatures for all portions of the ware stacks on the ware cars in a muffle kiln. Because the ware shrinks as it is fired, heating by radiation from the walls of the kiln can cause the ware on the outside of the ware stacks to shrink faster thus causing the ware stacks to tilt outward and presenting a danger of possible collapse.

The heat for the preheat section is supplied primarily by the hot gases exhausted from the firing section into a manifold. Supplementary heat is added by booster burners positioned in the preheat section manifold. Angled baffles with pivotable dampers are positioned within the preheat section manifold in the path of the hot exhaust gas to distribute the hot gases as desired throughout the preheat section. In this manner the desired degree of preheat can be controllably applied in a uniform way to the ware as it passes through the preheat section prior to its passage through the firing section.

It is therefore an object of this invention to provide a tunnel kiln firing section which overcomes the disadvantages of the prior art open fire and muffle kiln types. It is also an object of this invention to provide tunnel kiln preheat and firing sections capable of providing substantially uniform temperatures throughout the ware stacks on the ware cars.

According to the above and other objects, the present invention provides a tunnel kiln firing section including a tunnel structure made of refractory material and having a plurality of excess air burners spaced along the lower portion of each side of the tunnel structure. Hot combustion products from the burners plus entrained air are directed upward through damper controlled slots disposed adjacent the lower portions of the walls of the tunnel structure. The hot gases stream upward along the kiln wall, over along the kiln roof, downward and through the stacks of ware to be fired and are then drawn upward again with the fast-moving stream of burner combustion products so as to form a powerful current of recirculating hot gases which provides a uniform firing temperature throughout the stacks of ware being processed. Damper controlled exhaust ports are disposed between adjacent burners to lead a controlled amount of the heated gases from the firing section to other sections of the tunnel kiln so as to efficiently utilize the available heat energy.

The invention also provides a tunnel kiln preheat section having a similar tunnel structure which receives hot exhaust gases from the firing section. These hot gases are driven by a blower through an inlet manifold which distributes the gases through inlet orifices into the interior of the tunnel. Booster burners and variable baffles are provided within the manifold for further controlling the heat input to the preheat section. The gases stream upward along the kiln wall, over along the kiln roof, downward and through the stacks of ware to be fired, and are then drawn up again with the fast moving stream of incoming gases in the same manner as described for the firing section. Surplus gases are removed through exhaust ports into an exhaust manifold near the top of the kiln.

Other objects and advantages will be apparent from the following detailed description and accompanying drawings which set forth, by way of example, the principle of the present invention and the best mode contemplated for carrying out that principle.

Tunnel kilns are generally well known in the art and are described, for example, in U.S. Pat. Nos. 2,959,836; 2,961,732; 2,991,535 and 3,024,515 to William L. Hanley. As will be understood by those familiar with kilns of this type, the construction usually employs a suitable foundation and an overhead structural steel framework for supporting the kiln housing proper. The housing is normally constructed of brick and cementing materials, certain portions being constructed of refractory brick or castable refractory material where necessary. Further reference to the materials of construction is deemed unnecessary in view of the fact that suitable materials are well known and the type of materials used does not form a part of the present invention.

Figure 1:
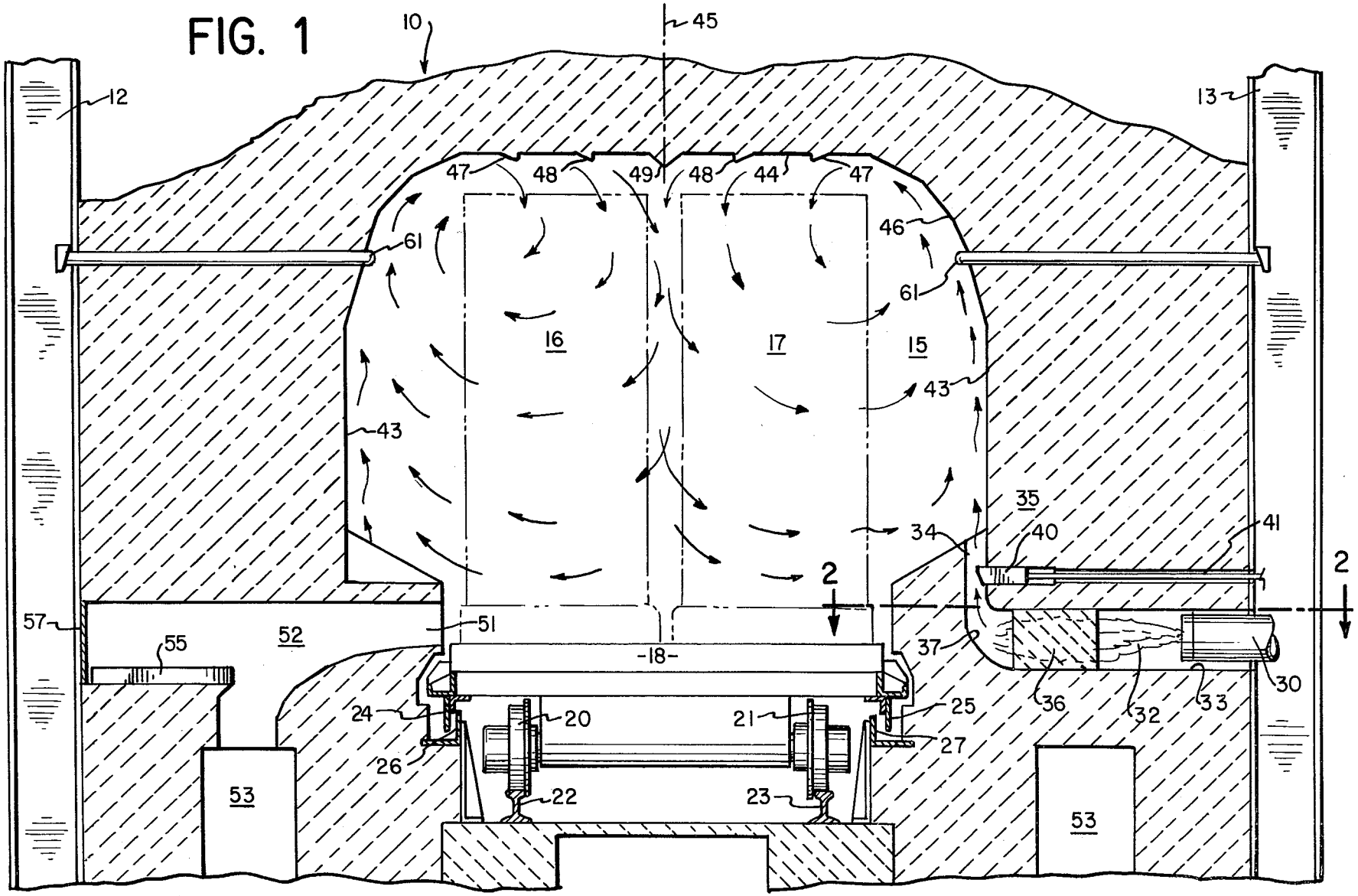
FIG. 1 is a cross-section of the tunnel kiln firing section of the present invention.

Referring in detail to FIG. 1 of the drawings, there is shown a cross-section of the tunnel kiln firing section of the present invention. The tunnel kiln housing, generally designated 10, is of refractory construction having a suitable foundation (not shown) and supported by a steel framework including, for example, steel columns 12 and 13.

The housing 10 encloses a tunnel 15 through which the stacks of ware 16, 17 are carried by a flatbed ware car 18. Ware car 18 has a pair of flanged wheels 20, 21 which ride on rails 22, 23 which extend along the length of the tunnel 15. Ware car 18 is also preferably provided with a pair of downwardly extending flanges 24, 25 which cooperate with the upwardly extending flanges 26, 27 of the tunnel housing 10 to inhibit the flow of heated gases from the firing zone above the bed of the car 18 to the area below the flatbed where the wheels 20, 21 and rails 22, 23 are located.

Ware car 18 is typically about 9 feet long although ware cars of greater or lesser length can be employed within the spirit and scope of the present invention. New ware cars are normally inserted into the entrance of the tunnel kiln at 40 to 60 minute intervals thus causing processed ware cars to be ejected from the tunnel exit at the same rate. Thus, the ware cars move through the tunnel at the rate of 1 foot every 4⅓ to 7 minutes.

Heat from the firing section of tunnel 15 is provided by a plurality of blower-drive excess air burners, such as burner 30, which are spaced along each side of the firing section. The excess air burners 30 may be of a conventional type, such as the dual fuel excess air burners manufactured by the North American Manufacturing Company of Cleveland, Ohio. These burners can be operated using either oil or gas.

According to the principle of the present invention, the excess air burners 30 are operated up to a ratio of 20 parts air to 1 part fuel. This is about twice the amount of air required for complete combustion of the fuel. Hence, the operating ratio of 20 parts air to 1 part fuel is sometimes called "100% excess air."

The important result of excess air operation is the relatively large volume of gases produced by the burner. A large volume of combustion products and entrained air is needed to provide the desired velocity for circulation through ware stacks 16 and 17 and for recirculation of the relatively cooler gases (such gases having been cooled by passage through stacks 16 and 17) within the firing section. The strong recirculation of these gases through the bungs, and the blending of them with the hotter gases from the excess air burner 30, insures uniform heating of the ware.

The relatively low initial temperature of the excess air gases blended together with the recirculated air also tends to promote more uniform heating of the ware throughout the ware stacks and avoids the possibility of bloating the ware which might result from impingement of open flame or excessively hot input gases. The temperature of the gases produced by the 100% excess air operation is in the range from 2400° to 2600° F. The temperature of the exhaust gases produced by "normal" operation (10 parts air to 1 part fuel) would be in the neighborhood of 3400° F. The relatively low temperature of the recirculated gases is the result of the very high amount of cooler air drawn from within the stacks.

Although it has been found that a ratio up to 20 parts air to 1 part fuel, or 100% excess air, generally provides efficient operation of the tunnel kiln firing section of the present invention, the temperature, volume and velocity of the input gases produced by burners 30 can be adjusted for optimum processing of the ware by adjusting the air/fuel mix and blower speed of the burners 30.

Figure 2:
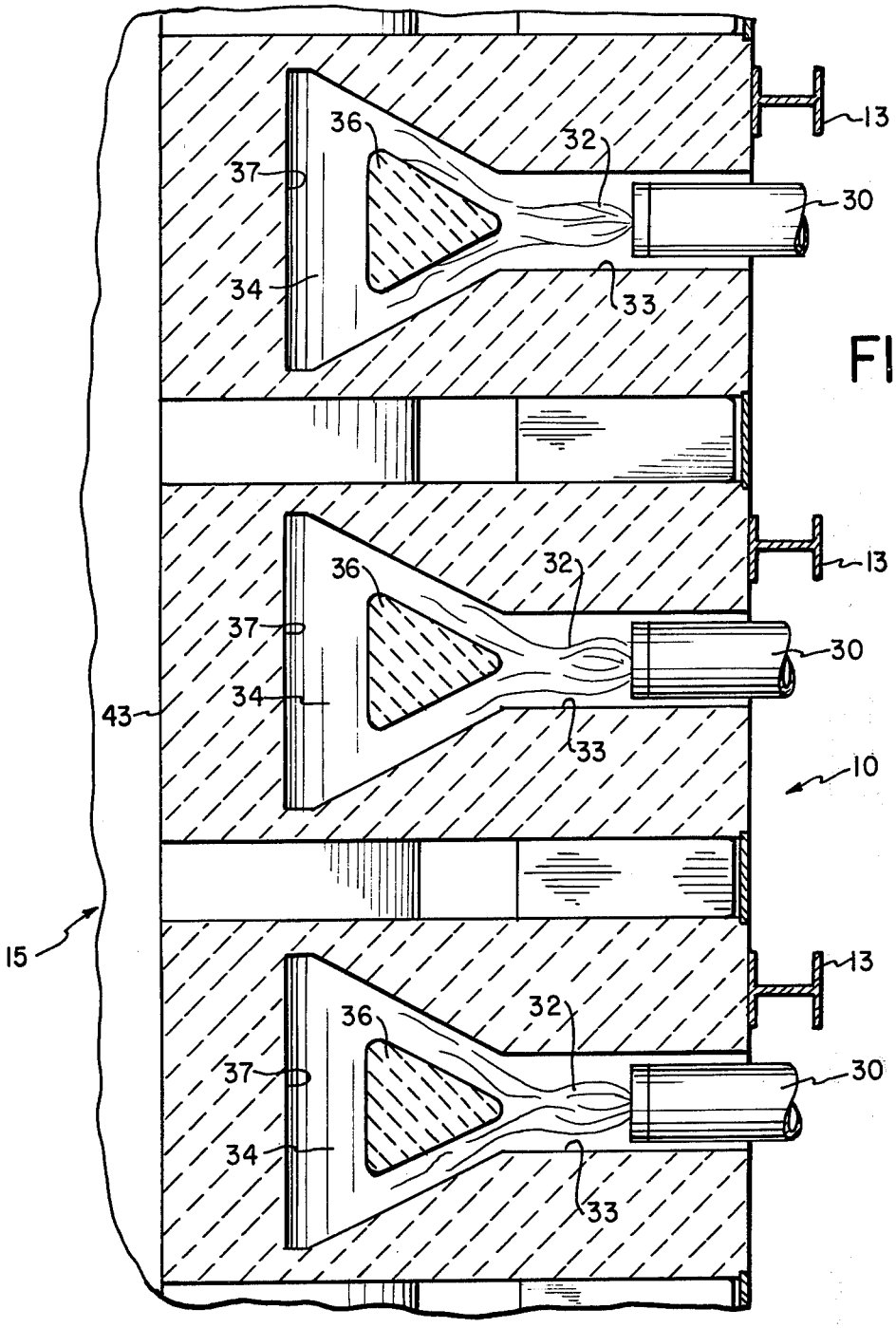
FIG. 2 is a cross-section taken along the line 2—2 of FIG. 1 showing the preferred arrangement of burners and exhaust ports along the side of the subject tunnel kiln firing section.

Referring now to FIG. 2 of the drawings, there is shown a cross-section of the plan of one side of the tunnel kiln firing section housing construction according to the present invention. Excess air burners 30 are spaced along each side of the firing section. In the preferred embodiment of the present invention, the burners 30 are spaced three feet on centers and there are 25 burners on each side of the firing section which is a total of about 75 feet in length. Hence, the firing section will contain about 8⅓ ware cars bumper to bumper as the 9 foot long ware cars move continuously through the tunnel kiln at the rate of 1 foot every 4⅓ to 7 minutes. It will also be apparent that, in the preferred embodiment of the present invention, there will be three burners on each side of each ware car at each point as the ware car moves through the firing section.

The exhaust 32 from each burner 30 moves through a duct 33 which spreads out and narrows down to an orifice 34 adjacent the side wall 35 (FIG. 1) of the tunnel kiln firing section. In the preferred embodiment of the present invention, triangular dividers 36 are located within the ducts 33 in order to spread the hot exhaust gases 32 from burners 30 with the full width of orifice 34. Dividers 36 may be made of refractory brick or other suitable refractory construction. Referring again to FIG. 1 of the drawings, the duct 33 turns upward after divider 36 to orifice 34. The wall 37 of duct 33 is appropriately curved to provide a streamlined flow of the exhaust gases 32.

A damper 40 is provided to control the width of the orifice 34. Because of the high temperatures to which it is subjected, the damper 40 is preferably made of a superduty castable refractory such as that supplied by the Harbison Walker Refractories Co. of Pittsburgh, Pa. The position of damper 40 is controlled by a rod 41 which may be manipulated by an operator in order to control the air circulation conditions within the firing section. The output of the blowers associated with burners 30 can also be manipulated through valves or dampers by the operator to control the volume and velocity of the hot gases circulating within the firing section.

By movement of the damper 40, the width of the orifice 34 may be adjusted in the range from zero to three inches. It will be appreciated by those skilled in the art that, as the width of the orifice 34 is decreased, the velocity of the exhaust gases will be increased. According to the preferred embodiment of the present invention, the velocity of the exhaust gases issuing from orifice 34 is in the range from about 2,500 feet per minute to about 3,000 feet per minute. It will be appreciated, however, that the exhaust velocity can be adjusted in order to fine tune the conditions within the firing section for most efficient processing of the ware. Velocities below 2500 feet per minute have been found not to provide the required circulation within the tunnel kiln firing section. Velocities exceeding 3000 feet per minute have not been found to produce any additional benefits.

The hot exhaust gases 32 from burner 30 stream upward through orifice 34 along the side wall 43 of the kiln housing 10. Because the orifices 34 are in the form of slots extending along the side wall 43 in the direction of the axis of the tunnel, the combined effect of adjacent burners 30 is to create a substantially continuous sheet of hot exhaust gases moving upward along the side wall 43 of the tunnel kiln housing 10. The sheet of hot gases proceeds upward and over along the roof of the tunnel kiln housing 10 towards its center line 45.

The transition between side wall 43 and roof 44 of the tunnel kiln housing 10 is preferably smoothly curved, as at 46, in order to provide a streamlined flow of the heated gases. The roof 44 of the tunnel kiln housing 10 may be provided with a plurality of deflectors 47, 48 and 49 to deflect the heated gases downward through the bungs 16 and 17 so as to promote a circulating flow of the heated gases. The deflectors 47, 48 and 49 may be made of brick or other refractory material and are in the form of ridges extending in the direction of the axis of the tunnel.

As indicated in FIG. 1, the heated gases move downward through the center of the tunnel kiln firing section between the bungs 16 and 17 and then outward through the lower portions of the bungs 16 and 17 to rejoin and be drawn along with the swiftly-moving stream of exhaust gases moving upward along the side walls 43 of the tunnel kiln housing 10. The result is to create powerful recirculating currents of heated gases. The recirculating currents move in a clockwise direction on the left-hand side of the tunnel kiln and in the counter clockwise direction of the right-hand side of the tunnel kiln as shown in FIG. 1. The temperature of the recirculating gases is extremely uniform and varies by only a few degrees throughout the bungs 16 and 17. Moreover, the amount of heating by radiation from the walls 43 is relatively minor so that the overall heating of the ware is extremely uniform, producing finished ware of uniform quality which requires little sorting.

In the preferred embodiment of the present invention heated gases are withdrawn from the tunnel kiln firing sections through exit ports 51 which are located between adjacent burners 30 as shown in FIG. 2. Exit ports 51 are connected by ducts 52 to exhaust manifolds 53 which extend along each side of the tunnel kiln housing 10. The volume of exhaust gases drawn off through each exit port 51 is controlled by an adjustable damper 55. In the preferred embodiment of the present invention, the damper 55 is simply a refractory block which rests on a ledge 56 and can be adjusted to the desired position by the kiln operator through access door 57.

A plurality of thermocouples 61 are provided along each side wall 43 of the tunnel kiln housing 10 for control purposes. The thermocouples 61 are located about 4 feet up the side wall 43 from orifice 34 and project about 1 inch into the stream of heated gases at intervals of about 18 feet along the length of the tunnel kiln firing section. The thermocouple 61 measures the temperature of the stream of heated gases at each thermocouple location and thus provides the kiln operator with information that he needs to create the desired temperature and circulation conditions within each portion of the tunnel kiln firing section of the present invention. The operator can adjust the conditions within the firing section by adjusting the air/fuel mix of each burner 30, the blower velocity of each burner 30, the position of each orifice damper 41, and the position of each exhaust damper 55. The adjustment of these individual controls and the relationship between them provides precise control of the temperature and circulation conditions within the present tunnel kiln firing section.

According to the preferred embodiment of the present invention, the temperature of the exhaust gases at the orifice 34 is in the range from 2400° to 2600° F. The temperature at the thermocouple 61 is a maximum of 2000° F. It is noted that the temperature of the heated gases drops sharply by 500° F or more during the brief 0.08 seconds of travel over the 4 foot distance between orifice 34 and thermocouple 61. As the ware progresses through the firing section it increases in temperature, so that the recirculated air becomes hotter.

Figure 3:
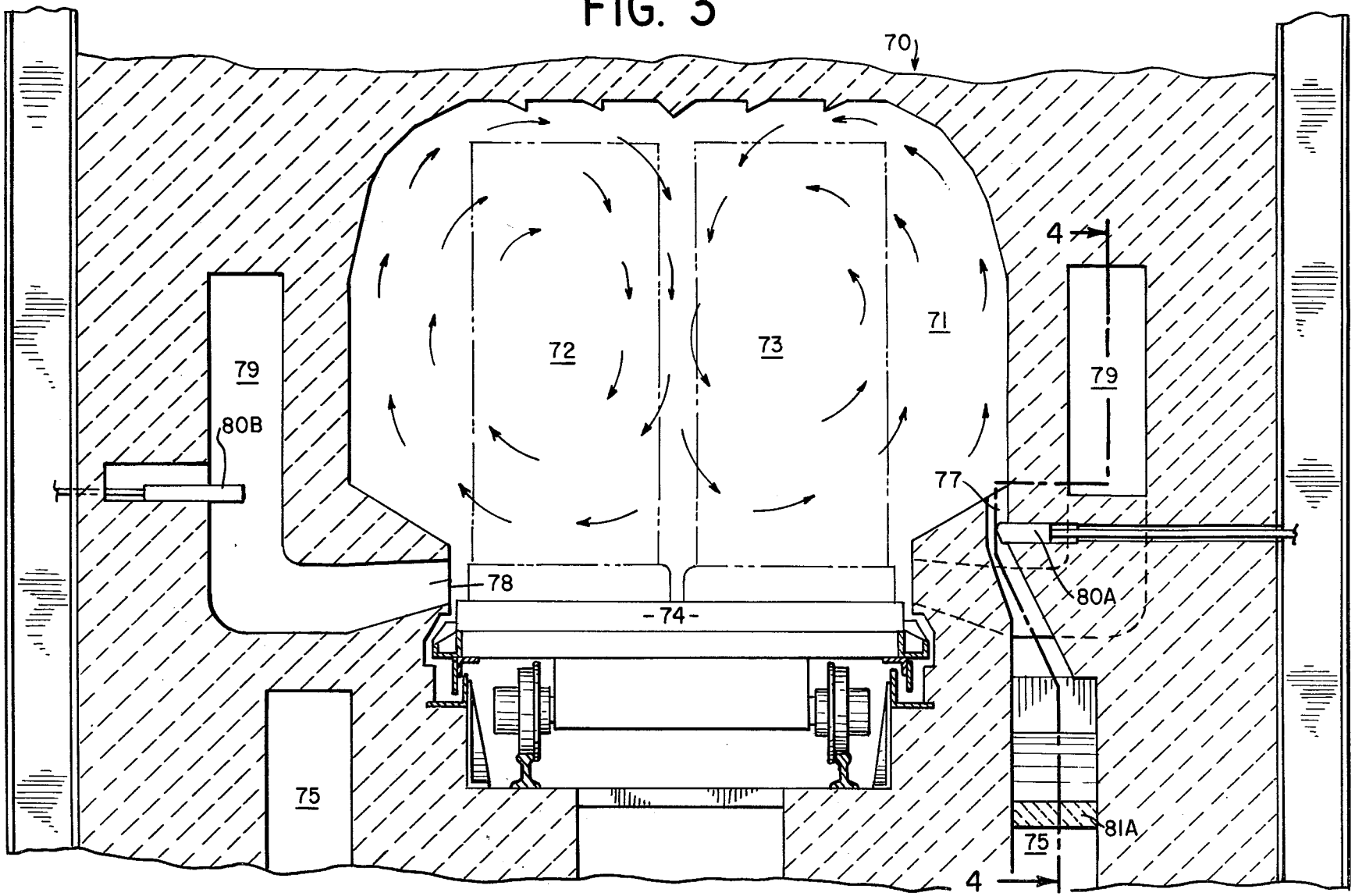
FIG. 3 is a cross-section of the tunnel kiln preheat section of the present invention.
Figure 4:
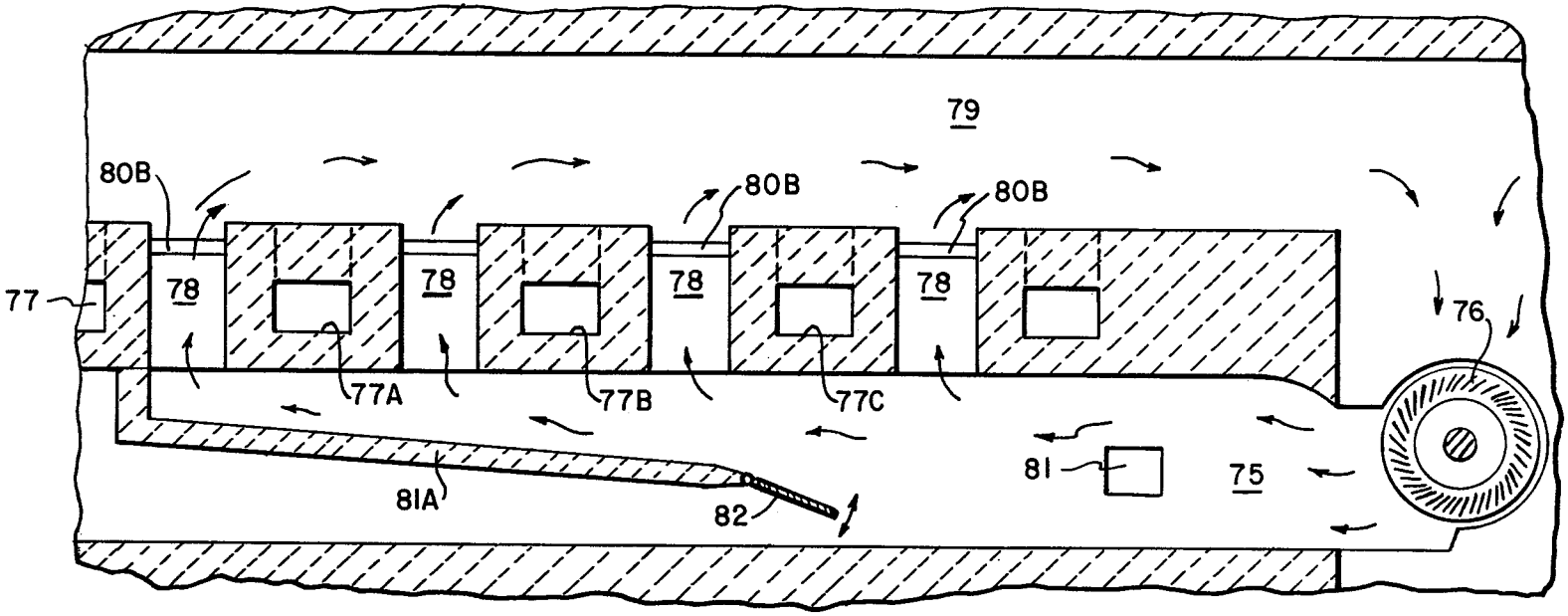
FIG. 4 is a typical half section taken along the longitudinal axis of the kiln showing the preferred arrangement of the blower, burner and baffle elements in the preheat section.

The heated gases withdrawn through exit ports 51 are conducted via exhaust manifolds 53 to the preheating section illustrated in FIGS. 3 and 4, thereby conserving the total amount of energy required for operation of the tunnel kiln. Referring now to FIGS. 3 and 4, there is shown in cross-section views the tunnel kiln preheat section of the present invention. The tunnel kiln housing, generally designated 70, is of refractory construction similar to that described above relative to the firing section. The housing 70 encloses a tunnel 71 through which the stacks of ware 72, 73 are carried by a flatbed ware car 74 similar to that previously described. In view of the similarity of these common features, further description is deemed unnecessary.

Heat from the firing section of tunnel 15 (FIG. 1) is provided to the preheat section by directing the hot gases from the exhaust manifolds 53 (FIG. 1) into inlet manifolds 75 of the preheat section. Blower 76 forces the hot gases into manifolds 75 and forces the gases through inlet ports 77 into tunnel 71. The gases stream upwardly along the outer sides of the tunnel, flowing upwardly and around toward the centerline of the roof of tunnel 71, then downwardly along the central vertical section of tunnel 71 to be drawn upwardly again in the same powerful recirculatory pattern as in the firing section. The surplus gases, being heavier, then flow outwardly along the tunnel bottom through exhaust ports 78. Exhaust ports 78 discharge the cooler gases into exhaust manifolds 79. A portion of the gases is then recirculated (and mixed with the hotter exhaust gases from the firing section) through blower 76. The balance of the gases (not recirculated) is discharged from the preheat section in a manner well-known in the art.

Inlet dampers 80A and exhaust dampers 80B are provided to adjust the size of the inlet ports 77 and outlet ports 78 respectively. They are constructed and operated in essentially the same manner as described above relative to the corresponding dampers in the firing section. Further description is therefore deemed unnecessary.

There are also provided in the preheat section booster burners 81, inclined baffles 81A and variable dampers 82. The function of these elements is to permit closer control of heat transfer in the preheat section. Thus baffle 81A serves to direct part of the incoming hot gases to the inlet ports 77A, B and C, while the balance passes to the inlet ports 77 downstream of baffle 81A.

Variable damper 82 is pivotally mounted on the end of baffle 81A to permit adjustment of the division of hot gases between the inlet ports upstream and downstream of baffle 81A. The position of damper 82 may be controlled from outside the kiln by a hand-operated lever (not shown) or any other conventional manipulative device.

Booster burner 81, as the designation implies, is provided to permit additional heat input, if and as necessary, to the preheat section. It will be understood that the conditions may vary, e.g., latent heat in exhaust gases from the firing section, difference in loads in the preheat section, ambient variations, which would require such additional heat input. The burner may be of the same type as those described above relative to the firing section.

While the principles of the present invention have been illustrated by reference to a preferred embodiment of the present tunnel kiln firing and preheat sections, it will be appreciated by those skilled in the art that various modifications and adaptations of the preferred embodiment may be made without departing from the spirit and scope of the present invention which is set forth with particularity in the appended claims.

What is claimed is:

1. A continuous tunnel kiln firing section comprising:

an elongated housing through which stacks of ware to be fired may be moved;

said housing comprising vertical sides, a horizontal roof connecting said sides, and means between the lower ends of the sides forming the base of said housing, said base means including means for continuously transporting the stacks of ware through said housing, a plurality of excess-air burners spaced along each side of said housing for generating high volume swiftly moving streams of hot gases;

a plurality of inlet ducts spaced longitudinally along the lower portion of each side of said housing and connected with said burners for directing the streams of hot gases from said burners upward in lateral non-longitudinal flow adjacent the inner walls of said sides;

a plurality of exhaust ducts spaced longitudinally along the lower portion of each side of said housing for exhausting excess gases from the housing;

said inlet and exhaust ducts being spaced relative to each other such that said hot gases circulate laterally over along the roof of said housing, laterally downward and through the stacks of ware to be fired, and are drawn upward again in substantially the same lateral flow path with the swiftly moving streams of hot gases from said burners to form a powerful lateral recirculating current of hot gases which provides substantially uniform temperatures on a given lateral plane throughout the stacks of ware to be fired.

2. The tunnel kiln firing section of claim 1 wherein said excess-air burners further comprise means for adjusting the flow of said streams of hot gases to control the volume and velocity of such flow.

3. The tunnel kiln firing section of claim 1 further comprising means for adjusting the air/fuel ratio of said excess-air burners to control the temperature of said swiftly moving streams of hot gases on a given lateral plane in said stacks.

4. The tunnel kiln firing section of claim 3 further comprising means for operating said excess-air burners at a ratio of about 20 parts air to 1 part fuel.

5. The tunnel kiln firing section of claim 1 wherein said excess-air burners are spaced along the lower portion of each side of said housing and said ducts direct the hot gases from said burners upward through elongated slot orifices spaced adjacent the lower portion of said side to create a substantially continuous sheet of hot gases moving upward adjacent the inner wall of said side, said burners providing a controlled temperature gradient with uniform lateral temperature planes and variable longitudinal temperature planes.

6. The tunnel kiln firing section of claim 5 wherein each of said orifices is provided with an adjustable damper for controlling the width of said orifice so as to control the velocity of the hot gases streaming through said orifice.

7. The tunnel kiln firing section of claim 1 further comprising means for controlling the velocity of said hot gases in the range from 2500 to 3000 feet per minute.

8. The tunnel kiln firing section of claim 1 further comprising means for controlling the temperature of said hot gases in the range from 2400° to 2600° F.

9. The tunnel kiln firing section of claim 5 further comprising a plurality of exhaust ports spaced along the lower portion of said side of said housing between said orifices, and further comprising an exhaust manifold connecting said exhaust ports for withdrawing hot gases from said tunnel kiln firing section.

10. The tunnel kiln firing section of claim 9 wherein each of said exhaust ports is provided with an adjustable damper for controlling the volume of hot gases withdrawn from said tunnel kiln firing section.

11. The tunnel kiln firing section of claim 5 further comprising a plurality of temperature measuring means spaced along the upper portion of said side of said housing for measuring the temperature of the swiftly moving sheet of hot gases.

12. The tunnel kiln firing section of claim 1 further comprising a plurality of deflectors projecting from the roof of said housing and extending parallel to the axis thereof for deflecting the current of hot gases downward and through the stacks of ware to be fired.

13. The tunnel kiln firing section of claim 9 wherein said burners and said orifices and said exhaust ports are spaced along both sides of said housing and said hot gases circulate up the side walls of said housing, over along the roof of said housing and downward at the center of said housing to form powerful recirculating currents rotating in opposite directions in opposite sides of said tunnel kiln firing section.

14. In association with a continuous tunnel kiln firing section, a tunnel kiln preheat section comprising:

an elongated housing through which stacks of ware to be preheated may be moved:

said housing comprising vertical sides, a horizontal roof connecting said sides, and means between the lower ends of the sides forming the base of said housing, said base means including means for continuously transporting the stacks of ware through said housing, means feeding exhaust gases from the tunnel kiln firing section to each side of said housing for generating high volume swiftly moving streams of hot gases; and a plurality of inlet ducts spaced longitudinally along the lower portion of each side of said housing and connected with said exhaust gas feed means for directing the streams of hot gases from said firing section upward in lateral non-longitudinal flow adjacent the side wall of said housing;

a plurality of exhaust ducts spaced longitudinally along the lower portion of each side of said housing for exhausting excess gases from the housing;

said inlet and exhaust ducts being spaced relative to each other such that said hot gases circulate laterally upwardly along the roof of ware to be preheated, and are drawn upward again in substantially the same lateral flow path with the swiftly moving streams of hot gases from said firing section to form a powerful lateral recirculating current of hot gases which provides substantially uniform temperatures in given lateral planes throughout the stacks of ware to be preheated.

15. The tunnel kiln preheat section of claim 14 further comprising blower means mounted to said housing for drawing the exhaust gases from the firing section and forcing such gases through said ducts.

16. The tunnel kiln preheat section of claim 15 further comprising a booster burner mounted to said housing for adding heat to said streams of hot gases.

* * * * *